United States Patent [19]

Wlodek

[11] Patent Number: 4,666,733

[45] Date of Patent: May 19, 1987

[54] METHOD OF HEAT TREATING OF WEAR RESISTANT COATINGS AND COMPOSITIONS USEFUL THEREFOR

[75] Inventor: Stanley T. Wlodek, Schenectady, N.Y.

[73] Assignee: Electric Power Research Institute, Palo Alto, Calif.

[21] Appl. No.: 776,840

[22] Filed: Sep. 17, 1985

[51] Int. Cl.[4] ..... B05D 1/10; B05D 3/02; C22C 29/08; C22C 38/06

[52] U.S. Cl. ..... 427/34; 75/240; 427/376.6; 427/423; 420/36

[58] Field of Search ..... 427/34, 423, 376.6; 75/240, 124, 126 R

[56] References Cited

U.S. PATENT DOCUMENTS 4,275,090 6/1981 McComas et al. ..... 427/34
4,275,124 6/1981 McComas et al. ..... 428/564

*Primary Examiner*—Michael R. Lusignan
*Attorney, Agent, or Firm*—Flehr, Hohbach, Test, Albritton & Herbert

[57] ABSTRACT

Method is provided for forming an improved wear resistant coating on a metallic surface. Novel compositions for forming said coating are provided consisting essentially of 60 to 90% by volume $Cr_3C_2$ and 40 to 10% by volume of a matrix alloy of CoCrNiW, FeCrAlY, or mixtures thereof.

7 Claims, 4 Drawing Figures

METHOD OF HEAT TREATING OF WEAR RESISTANT COATINGS AND COMPOSITIONS USEFUL THEREFOR

The present invention is directed to a method for forming an improved wear resistant coating on metallic surfaces and to compositions useful for forming such coatings. In particular, the present invention is directed to a method for forming a wear resistant chromium carbide coating on metallic surfaces.

BACKGROUND OF THE INVENTION

There is a need for improved wear resistant coatings for metallic surfaces for use in high-stress environments, such as for steam turbine components. For example, erosion caused by solid particles in steam turbine components in power utilities is a significant problem costing in the area of hundreds of millions of dollars per year in utilities in the United States.

It is therefore an object of the present invention to provide improved coatings for metallic surfaces characterized by improved hardness and resistance to erosion, particularly to erosion by solid particles. It is a further object of the present invention to provide novel compositions which are useful for forming coatings on metallic surfaces characterized by improved hardness and resistance to erosion.

SUMMARY OF THE INVENTION

The present invention provides a method for forming a wear resistant coating on a metallic surface comprising steps of applying to such surfaces a composition comprising chromium carbide ($Cr_3C_2$) under oxidizing conditions sufficient to form a coating comprising metastable, carbon-deficient $Cr_3Cr_2$ on the surface, and hardening the coating by exposure to a temperature in the range of 900° to 1300° F. The present invention further provides novel compositions for use in forming the improved coatings to where the compositions consist essentially of 60 to 90 volume percent of $Cr_3Cr_2$ and 40 to 10 volume percent of an alloy selected from the group consisting of Co-28–32%(wt.)Cr-9–11%(wt.)Ni-3.5–5.5%(wt.)W, Fe-28–31%(wt.)Cr-4.5–5.5%(wt.)Al-0.4–0.6%(wt.)Y, and mixtures thereof.

DESCRIPTION OF THE INVENTION

Figure 1:
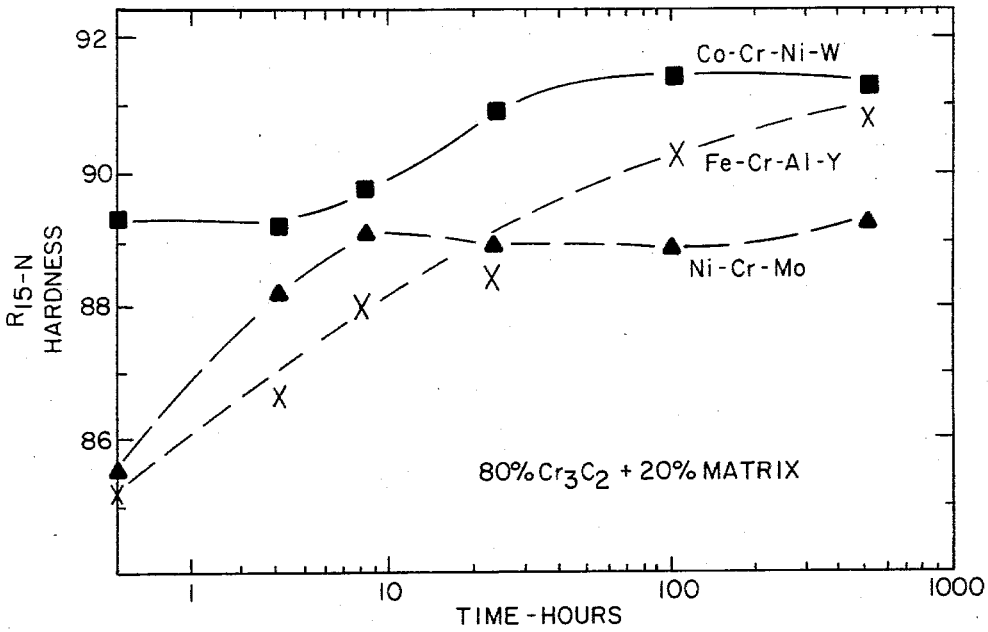
FIG. 1 is a plot of hardness versus time for 80% $Cr_3C_2$ plus 20% of a matrix alloy.

The present invention is based in part on the discovery that when $Cr_3C_2$ based coatings are coated onto metallic surfaces under oxidizing conditions, a metastable, carbon-deficient form of $Cr_3C_2$ is deposited. According to the present invention, the formation of such metastable carbon-deficient $Cr_3C_2$ coating, followed by aging by exposure of the coating to a temperature in the range of 900° to 1300° F. results in the formation of an improved, hardened, wear resistant coating which is particularly resistant to solid particle erosion.

The coatings according to the present invention may be formed by applying the coating composition onto the surface of the metal to be coated under oxidizing conditions. This includes conditions of conventional plasma-sprayed coatings in air. When conducted in air such conventional plasma-spraying procedures produce an oxidizing condition whereby the $Cr_3C_2$ is coated onto the surface of the metal as a metastable, carbon-deficient form. The spraying composition may comprise pure $Cr_3C_2$. By carbon-deficient, it has been found that the $Cr_3C_2$ which is deposited contains approximately 22%, by weight, less carbon than required by the emperical formula $Cr_3C_2$.

It has further been found, that a particular coating composition consisting essentially of 60 to 90 volume percent $Cr_3Cr_2$ and 40 to 10 volume percent of a matrix alloy is particularly advantageous in achieving the hardened coatings according to the present invention. The matrix alloy may be either of two four-component alloys, or mixtures thereof, which are selected from the group consisting of Co-28–32%(wt.)Cr-9–11%(wt.)Ni-3.5–5.5%(wt.)W and Fe-28–31%(wt.)Cr-4.5–5.5%(wt.)Al-0.4–0.6%(wt.)Y. It will be understood that either of these alloys may also contain incidental impurities such as carbon, silicon, manganese, molybdenum, sulfur, phosphorous, and the like, which do not materially affect the erosion resistant properties of the coating.

Typical matrix alloys useful in accordance with the present invention are shown below in Tables 1 and 2.

TABLE 1

SPECIFICATION FOR FeCrAlY POWDER

| Element | Nominal Aim, Weight Percent | Acceptable Range, Weight Percent |
|---|---|---|
| Fe | Base | Remainder |
| Cr | 30 | 28–31 |
| Al | 5 | 4.5–5.5 |
| Y | 0.5 | 0.4–0.6 |
| Si | — | 0.5 max. |
| C | — | 0.1 max. |
| S | — | 0.01 max. |
| P | — | 0.02 max. |
| O | — | 400 ppm max. |
| O + N | — | 600 ppm max. |

Usually prepared as a powder −325 mesh, argon atomized.

TABLE 2

SPECIFICATION FOR CoCrNiW ALLOY POWDER

| Element | Nominal Aim, Weight Percent | Acceptable Range, Weight Percent |
|---|---|---|
| Co | Base | Remainder |
| Cr | 30 | 28–32 |
| Ni | 10 | 9–11 |
| W | 4.5 | 3.5–5.5 |
| C | 0.4 | 0.3–0.5 |
| Fe | — | 1.0 max. |
| Mo | — | 0.5 max. |
| Si | — | 0.5 max. |
| S | — | 0.01 max. |
| P | — | 0.02 max. |
| O | — | 400 ppm max. |
| O + N | — | 600 ppm max. |

Usually prepared as a powder −325 mesh, argon atomized.

There is no particularity in the thickness of the coating applied to the surface of the metal. It is within the skill of those of ordinary skill in the art to determine the thickness of the coating for the particular intended application of the final coated product. In a typical instance, a coating will be applied so that the final cured coating will be a thickness of around 10 mils.

After applying the coating, the coated component is then subjected to aging to harden the coating by exposing to a temperature in the range of 900° to 1300° F. While not intending to be limited to any particular theory, it is believed that at these temperatures the metastable $Cr_3C_2$ transforms to and precipitates a carbide of lower carbon content, having the formula $Cr_7C_3$. It is thus believed that the formation of this transformed product increases the hardness of the coatings and improves the wear resistance, particularly to solid particle erosion.

The time for which the coating must be cured at these temperatures depends upon the thickness of the coating, the size and shape of the coated article and other parameters from which the curing time can be determined by those of ordinary skill in the art. In the usual instance, curing will be completed within about 200 to 1000 hours, and usually within about 500 hours at 1000° F.

The type of metals which may be coated according to the method of the present invention include those which may be conventionally coated by wear resistant coatings. These metals include ferrous alloys, steels and stainless steels.

The coatings according to the present invention are advantageous in that they improve the solid particle erosion of the coated article by improving the wear and erosion resistance of the article.

Having described the preferred embodiments of the invention above, the following examples are provided by way of example, but not by way of limitation.

EXAMPLE 1

The (−325) mesh powders of the Co-30%Cr-10%Ni-4%W, Fe-30%Cr-5%Al, and 1%Y alloy were plasma sprayed using the conditions given in Table 3 onto an investment cast impulse airfoil. Coatings 10 mil thick were prepared. For comparison purposes, coatings of a Ni-20%Cr-10%Mo chemistry were also applied and under identical conditions. All specimens were aged 500 hours at 1000° F.

TABLE 3

PLASMA DEPOSITION CONDITIONS FOR $CR_3C_2$ COATINGS

| | |
|---|---|
| Nozzle | 704 |
| Powder Port | No. 5 |
| Arc Current | 1000 A |
| Arc Voltage | 40 V |
| Primary/Secondary Gas | Argon |
| Primary/Secondary Pressure | 100 psi |
| Primary/Secondary Flow | 100 |
| Carrier Gas Flow | No. 50 setting |
| Meter Wheel | S |
| Feed Rate | 5–6 lbs./hr. |
| Spray Distance | 2½" |
| Air Jets | 50 psi 5" Intersect |

All above apply to 7MB gun.

Figure 3:
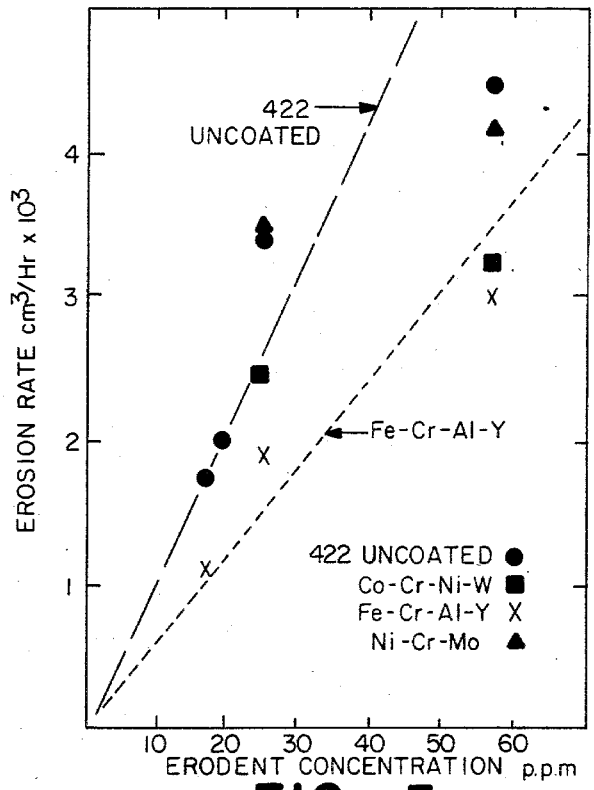
FIG. 3 is a plot of erosion rate versus erodent concentration for coated and uncoated type 422 stainless steel.
Figure 4:
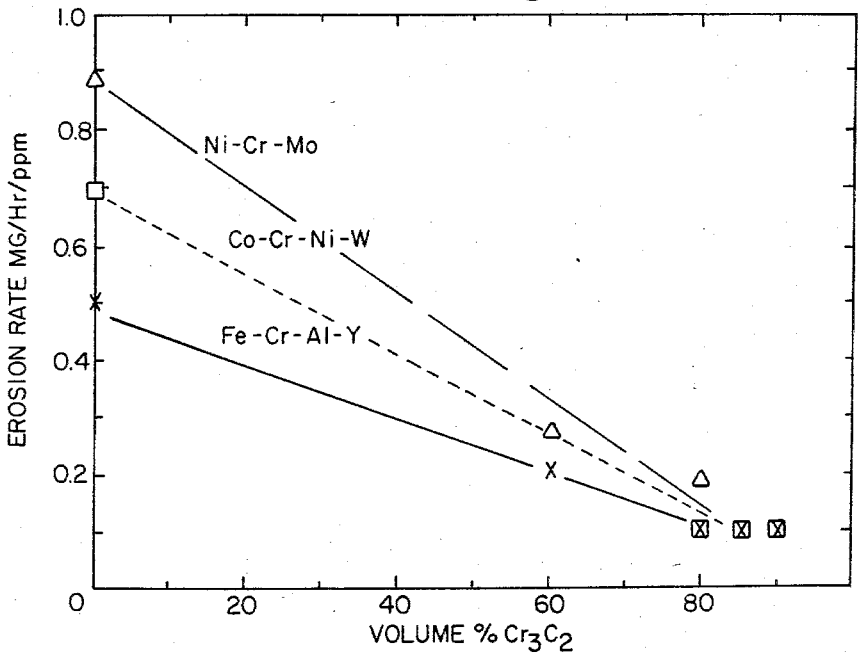
FIG. 4 is a plot illustrating the effect of increasing $Cr_3C_2$ content in coating compositions.

When tested at 1000° F. to erosion by minute (−325 mesh) particles of very erosive chromite, traveling at velocities of close to 1040 feet/second, the CoCrNiW and FeCrAlY chemistries proved, as shown by the lower weight losses in FIG. 3, to be almost twice as erosion resistant as the NiCrMo composition or the uncoated Type 422 stainless steel, regardless of the concentration of erodent used in the test. Type 422 stainless steel and similar martensitic stainless alloys are typical materials from which steam turbine buckets are manufactured. Due to their softness (244 Knoop as-sprayed, 400 Knoop after 500 hours at 1000° F.), the excellent erosion resistance of the FeCrAlY coating is noted as particularly surprising. The CoCrNiW and NiCrMo alloys had a hardness of 620 and 520 Knoop after 500 hours at 1000° F. aging.

EXAMPLE 2

The same CoCrNiW and FeCrAlY chemistries as used in Example 1 were blended as −325 mesh powders with −325 mesh $Cr_3C_2$ in amounts of 60, 80, 85, and 90 volume percent $Cr_3C_2$. For comparison purposes, similar blends were prepared using the Ni-20%Cr-10%Mo composition, which represents the family of Ni-20%Cr+$Cr_3C_2$ coatings used commercially for improving the high temperature erosion and wear resistance of gas turbine and steam turbine components. These $Cr_3C_2$ alloy powder mixtures were plasma sprayed onto miniature airfoils of Type 422 stainless and, after aging for 500 hours at 1000° F., erosion tested at 1000° F. and 1050 feet/second erodent velocity, using the procedures of Example 1.

The resultant rate of coating penetration, as measured at the point of maximum erodent attack, a point on the pressure wall of the coated airfoil, some one-third of the chord length from the trailing edge, was taken as a measure of erosion resistance. These measurements, made by planimeter and metallographic techniques after completion of testing, were normalized to unit time and unit erodent concentration. Coatings of the type 90% $Cr_3C_2$+10 volume percent FeCrAlY exhibited a normalized penetration rate of $3\times10^{-3}$ mils/hour/ppm, compared to 24 to $28\times10^{-3}$ mils/hr/ppm for uncoated Type 422 stainless steel.

EXAMPLE 3

A specimen of 80 volume percent $Cr_3C_2$+20 volume percent FeCrAlY coating was tested under conditions of erosion by PFB dust. The test was performed at 1360° F. using 99 ppm of Malta 2+3 PFB dust. As tabulated below (Table 4), in terms of the weight loss comparison of the 10 mil $Cr_3C_2$+FeCrAlY coating to various high temperature alloys and coatings, the $Cr_3C_2$+FeCrAlY was essentially unaffected by the 250 hour test that caused large weight losses of other materials normally used for high temperature service.

TABLE 4

| Material | 250 Hour Weight Change, mg |
|---|---|
| FSX | −308 |
| IN738 | −350 |
| IN671 Clad IN738 | −87 |
| GE2541 Clad IN738 | −132 |
| ATD2 CoCrAlY on IN738 | −309 |
| RT22 Clad IN738 | −138 |
| 80 vol. % $Cr_3C_2$ + 20 vol. % FeCrAlY | +3 |

EXAMPLE 4

Airfoil specimens of Type 422 were sprayed with 10 mil coatings of 85 volume percent $Cr_3C_2$+15 volume percent Ni-20Cr and 85 volume percent $Cr_3C_2$+15 volume percent FeCrAlY using the same procedures as in Example 2. When tested at 1000° F., 1040 feet/-second, 25 ppm chromite erodent, the following erosion rates were found:

| | Specific Erosion Rate | |
|---|---|---|
| | PW Penetration mils/hr/ppm | Weight Loss mg/hr/ppm |
| 85 vol. % $Cr_3C_2$ + 15 vol. % Ni – 20% Cr | 6 | 0.13 |
| 85 vol. $Cr_3C_2$ + 15 vol. % FeCrAlY | 1.5 | 0.07 |
| Uncoated Type 422 | 14 | 0.55 |

EXAMPLE 5

Coupons of Type 422 stainless were plasma sprayed with mixtures of 80 volume percent $Cr_3C_2$+20 volume percent of a matrix alloy selected from one of the following alloys, all percentages are by weight, unless otherwise stated.

Co-30%Cr-10%Ni-4%W, Fe-30%Cr-5Al-1%Y, Ni-20%Cr-10%Mo, all components being −325 mesh powders using the air plasma spraying conditions given in Table 3. When aged 500 hours in ambient pressure steam, Knoop hardness of these 10 mil coatings was found to increase as follows:

| | Hardness (Knoop) | |
|---|---|---|
| Coating | As-Sprayed | Aged 500 Hours 1000 F. |
| 80 vol. % $Cr_3C_2$ + 20 vol. % CoCrNiW | 720 | 1390 |
| 80 vol. % $Cr_3C_2$ + 20 vol. % FeCrAlY | 706 | 1480 |
| 80 vol. % $Cr_3C_2$ + 20 vol. % NiCrMo | 924 (Measured 12/27/82) | 1490 (Measured 1/22/83) |

EXAMPLE 6

Using the same materials and spraying procedures as detailed in Example 5, 10 mil thick coatings were aged in air for 4, 10, 16, 100, and 500 hours. After each of the above aging periods, superficial $R_{15N}$ hardnesses were taken. The results are plotted in FIG. 1. The hardness of the CoCrNiW and FeCrAlY coatings are significantly harder than the NiCrCo-containing coating after about 20 hours aging.

EXAMPLE 7

Figure 2:
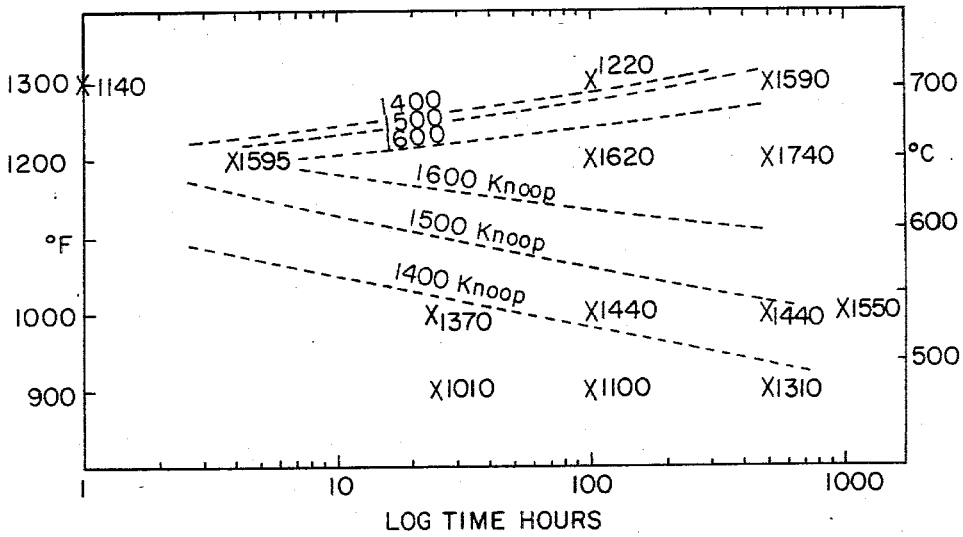
FIG. 2 is a plot of hardness as a function of time and temperature of aging of 85–90% $Cr_3C_2$ plus FeCrAlY coatings.

Using the same procedure as outlined in Example 5, coatings of the composition 85 volume percent $Cr_3C_2$+15 volume percent FeCrAlY and 90 volume percent $Cr_3C_2$+10 volume percent FeCrAlY were plasma sprayed and aged for up to 1,000 hours over the temperature range of 900° to 1300° F. After mounting and polishing sections of the coating, Knoop hardnesses were taken and their average recorded in FIG. 2, indicating that the optimum hardening temperature is about 1200° F. and that an increase in hardness can occur on aging as low as 900° F.

EXAMPLE 8

Using the spraying procedure given in Table 3, 10 mil thick coatings of 85 volume percent $Cr_3C_2$+15 volume percent FeCrAlY were applied to miniature airfoils which were subjected to erosion testing at 1000° F. As shown by the tabulation given below, the aging treatment improved the erosion resistance:

| | Knoop | Normalized Erosion Rate | |
|---|---|---|---|
| Condition | Hardness | mg/hr/ppm | mils/hr/ppm |
| No Heat Treatment | 1430 | 0.2 | 10 |
| Aged 500 Hours 1000° F. | 1410 | 0.1 | 5 |
| Uncoated Type 422 | 380 | 1.0 | 28 |

even though the erosion test, which lasted for 40 hours, was still equivalent to a partial aging treatment.

EXAMPLE 9

Six Type 422 airfoils were plasma sprayed with 80 volume percent $Cr_3C_2$+20 volume percent CoCrNiW alloy and tested per the procedure of Example 8. Three of the airfoils were plasma sprayed using coarse (−200 +325 mesh) $Cr_3C_2$, the other three using fine (−325 mesh). Except for the difference in particle size, the spraying procedure of Table 3 was used. All specimens were aged 500 hours at 1000° F. before testing with the following results:

| | Knoop | Normalized Erosion Rate | |
|---|---|---|---|
| Condition | Hardness | mg/hr/ppm | mils/hr/ppm |
| −200 +325 Mesh Carbide | 700 | 0.6 | 12 |
| −325 Mesh Carbide | 1200 | 0.1 | 6 |

EXAMPLE 10

Three Type 422 airfoil specimens were plasma sprayed with 80 volume percent $Cr_3C_2$+20 volume percent FeCrAlY using the so-called low pressure plasma spraying (LPPS) process. In this process, spraying is performed in a reduced pressure of 60 microns of argon using a very high energy 80 KW, Mach 3 spraying system. As tabulated below, the LPPS process produced coatings with lower erosion resistance than conventional plasma spraying (see Example 8), but erosion resistance of the two specimens that were aged was still better than the one specimen that was not aged prior to erosion testing.

| | Knoop | Normalized Erosion Rate | |
|---|---|---|---|
| Condition | Hardness | mg/hr/ppm | mils/hr/ppm |
| LPPS Not Aged | 1230 | 0.6 | 26 |
| LPPS Aged 500 Hours/ 1000° F. | 1410 | 0.3 | 12 |

We claim:

1. A method for forming a wear-resistant chromium carbide coating on a metallic surface comprising the steps of applying to said surface a composition consisting essentially of 60–90 volume % $Cr_3C_2$ and 40–10 volume % of an alloy selected from the group consisting of Co-28–32%(weight)Cr-9–11%(weight)Ni-3.5–5.5%(weight)W, Fe-28–31%(weight)Cr-4.5–5.5%-(weight)Al-0.4–0.6%(weight)Y, and mixtures thereof under oxidizing conditions sufficient to form a coating comprising metastable, carbon-deficient $Cr_3C_2$; and hardening said coating by exposure to a temperature in the range of 900°–1300° F.

2. A method according to claim 1 wherein said step of applying said composition to said surface comprises spraying said composition as a plasma in air onto said surface.

3. The method according to claim 1 wherein said alloy is selected from the group of Co-30%Cr-10%Ni-4%W, Fe-30%Cr-5%Al-0.5%Y, and mixtures thereof.

4. A composition consisting essentially of 60 to 90 volume percent $Cr_3C_2$ and 40 to 10 volume percent of an alloy selected from the group consisting of Co-28–32%(wt.)Cr-9–11%(wt.)Ni-3.5–5.5%(wt.)W, Fe-28–31%(wt.)Cr-4.5–5.5%(wt.)Al-0.4–0.6%(wt.)Y, and mixtures thereof.

5. A composition according to claim 4 wherein said composition is selected from the group consisting of Co-30%Cr-10%Ni-4%W, Fe-30%Cr-5%Al-0.5%Y, and mixtures thereof.

6. A composition according to claim 4 or 5 wherein said alloy consists essentially of CoCrNiW.

7. A composition according to claim 4 or 5 consisting essentially of FeCrAlY.

* * * * *